US010068549B2

(12) United States Patent
Verbeure et al.

(10) Patent No.: US 10,068,549 B2
(45) Date of Patent: Sep. 4, 2018

(54) CURSOR HANDLING IN A VARIABLE REFRESH RATE ENVIRONMENT

(71) Applicant: NVIDIA Corporation, Santa Clara, CA (US)

(72) Inventors: Tom Verbeure, Sunnyvale, CA (US); Timothy John Bornemisza, San Jose, CA (US)

(73) Assignee: NVIDIA CORPORATION, Santa Clara, CA (US)

( * ) Notice: Subject to any disclaimer, the term of this patent is extended or adjusted under 35 U.S.C. 154(b) by 336 days.

(21) Appl. No.: 14/856,495

(22) Filed: Sep. 16, 2015

(65) Prior Publication Data

US 2017/0075432 A1 Mar. 16, 2017

(51) Int. Cl.
*G09G 5/08* (2006.01)

(52) U.S. Cl.
CPC ..... *G09G 5/08* (2013.01); *G09G 2340/0435* (2013.01); *G09G 2340/10* (2013.01); *G09G 2340/12* (2013.01)

(58) Field of Classification Search
CPC ..... G09G 5/08; G09G 2340/0435; G09G 2340/10; G09G 2340/12
See application file for complete search history.

(56) References Cited

U.S. PATENT DOCUMENTS 4,691,200 A * 9/1987 Stephany ..... G09G 3/20 345/157
8,334,857 B1 * 12/2012 Ogrinc ..... G09G 5/377 345/204
2004/0150619 A1 * 8/2004 Baudisch ..... G06F 3/04812 345/157
2015/0194111 A1 7/2015 Slavenburg et al.
2015/0243233 A1 8/2015 Bloks et al.
2015/0243234 A1 * 8/2015 Bloks ..... G09G 3/3614 345/96
2017/0053620 A1 * 2/2017 Law ..... G09G 5/363

OTHER PUBLICATIONS

Verbeure, T. et al., U.S. Appl. No. 14/720,563, filed May 22, 2015.

* cited by examiner

*Primary Examiner* — Mark Edwards
(74) *Attorney, Agent, or Firm* — Zilka-Kotab, LLC

(57) ABSTRACT

A method, computer program product, and system for cursor handling in a variable refresh rate environment are disclosed. The method includes the steps of receiving a first image, combining a cursor at a first position with the first image to produce a first combined image, and displaying the combined image on a variable refresh rate display device. The method also includes the steps of determining that a refresh timeout associated with the variable refresh rate display device has occurred, and then, after determining that a second image has not been generated, combining the cursor at a second position with the first image to produce a second combined image for display. The logic for implementing the method may be included in a graphics processing unit or within the variable refresh rate display device itself.

20 Claims, 10 Drawing Sheets

CURSOR HANDLING IN A VARIABLE REFRESH RATE ENVIRONMENT

FIELD OF THE INVENTION

The present invention relates to display systems, and more particularly to a variable refresh rate display.

BACKGROUND

Conventional display devices (e.g., Cathode Ray Tube (CRT), Liquid Crystal Displays (LCD), Light Emitting Diode (LED), Organic LED (OLED), Active-Matrix OLED (AMOLED), etc.) operate at fixed refresh rates such as 60 Hz, 85 Hz, or 120 Hz. In other words, the display device is configured to refresh each of the pixels of the screen at a specific frequency. In conventional systems, the video signal transmitted to the display device must match the fixed frequency of the display device's refresh rate. Some display devices enable the fixed frequency refresh rate to be changed based on a configuration setting of the display device, but once that setting is changed, each frame received by the display device is drawn to the screen at that fixed frequency. However, a graphics processing unit (GPU) may generate frames of pixel data at a variable rendering rate that is asynchronous with the fixed refresh rate of the display device.

For example, when a display device is operating at 60 Hz, the pixels of the display will be refreshed every 16.6 ms. However, each frame may take a variable amount of time to be rendered by the GPU so while one frame may take 12 ms to render, another frame with more complicated geometry may take 30 ms to render. Thus, completely rendered frames may not be ready in the frame buffer when the next frame needs to be output to the display device via a video interface. In this case, the previous image needs to be repeated in part or completely, which can cause image artifacts. For example, image tearing may occur if the image being output to the display device is switched part way through the frame (V-SYNC Off). Conversely, image stuttering may occur if the image being output to the display device is only switched between frames, thereby causing some frames to be repeated and/or causing some frames to be skipped (V-SYNC On).

Newer display devices may be configured to operate synchronously with the GPU utilizing a dynamic refresh frequency. For example, some monitors may be compatible with NVIDIA's G-SYNC™ technology that enables the display device to synchronize the refresh of pixel elements for displaying a frame with the variable rendering rate of the GPU. The GPU is configured to transmit frames of pixel data to the display device via the video interface immediately after the frame has been rendered, and the display device is configured to refresh the pixels of the display device in response to receiving the frames of pixel data rather than at a fixed frequency refresh rate. In other words, the refresh rate of the display device is not fixed at a particular frequency, but instead adjusts dynamically to the rate image data is received from the GPU.

As long as the GPU renders frames of image data at a reasonably fast rendering rate, the types of image artifacts associated with conventional systems may be reduced. However, in some cases, the GPU may have trouble rendering particular frames in a reasonable amount of time due to the complexity of a scene. For example, a particular frame of pixel data may take, e.g., 100 ms to be rendered, which corresponds to a dynamic refresh frequency of 10 Hz for that particular frame. The effective refresh rate of the monitor when there are large delays between successive frames may cause issues.

For example, most image display technologies (e.g., LCD panels) have a lower and upper bound refresh frequency at which the display can reproduce an image with maximum quality. When the displays were driven at a fixed frequency refresh rate, this operational restriction was easy to meet because the fixed refresh frequency could be selected within the lower and upper bounds of the display. However, when using a variable refresh rate technology, such as NVIDIA's G-SYNC™ technology, the GPU may require a variable and unpredictable amount of time to generate the next image data for display. The amount of time required to generate the next frame of image data for display can be larger than the amount of time available while staying above the minimum refresh frequency requirements of the display.

Further complicating the refresh operation when variable refresh technology is used is display of a cursor (e.g., mouse pointer) as an extra layer over the image that is rendered by the GPU. When a user moves the mouse, the mouse cursor on the screen should update with a high enough refresh rate to ensure an interactive experience. When a fixed frequency refresh rate is used the cursor is simply composited or overlaid with the image that is displayed (either a new image or a repeated image). In a variable refresh rate environment, updating the cursor only when a new image is generated by the GPU may not provide an interactive experience. For example, if the GPU produces new images at 10 Hertz, then the cursor response will be sluggish. Alternatively, if the display device is refreshed whenever the mouse position changes (by overlaying the cursor on a repeated image), then the cursor controlled refreshes may delay the display of a new image, resulting in visual stutter. Without taking into account the critical nature of the timing at which the display device is refreshed, the asynchronous nature of mouse movements compared to the render rate of the GPU can result in serious visual flicker. Thus, there is a need for addressing these issues and/or other issues associated with the prior art.

SUMMARY

A method, computer program product, and system for cursor handling in a variable refresh rate environment are disclosed. The method includes the steps of receiving a first image, combining a cursor at a first position with the first image to produce a first combined image, and displaying the combined image on a variable refresh rate display device. The method also includes the steps of determining that a refresh timeout associated with the variable refresh rate display device has occurred, and then, after determining that a second image has not been generated, combining the cursor at a second position with the first image to produce a second combined image for display. The logic for implementing the method may be included in a graphics processing unit or within the variable refresh rate display device itself.

DETAILED DESCRIPTION

Figure 1:
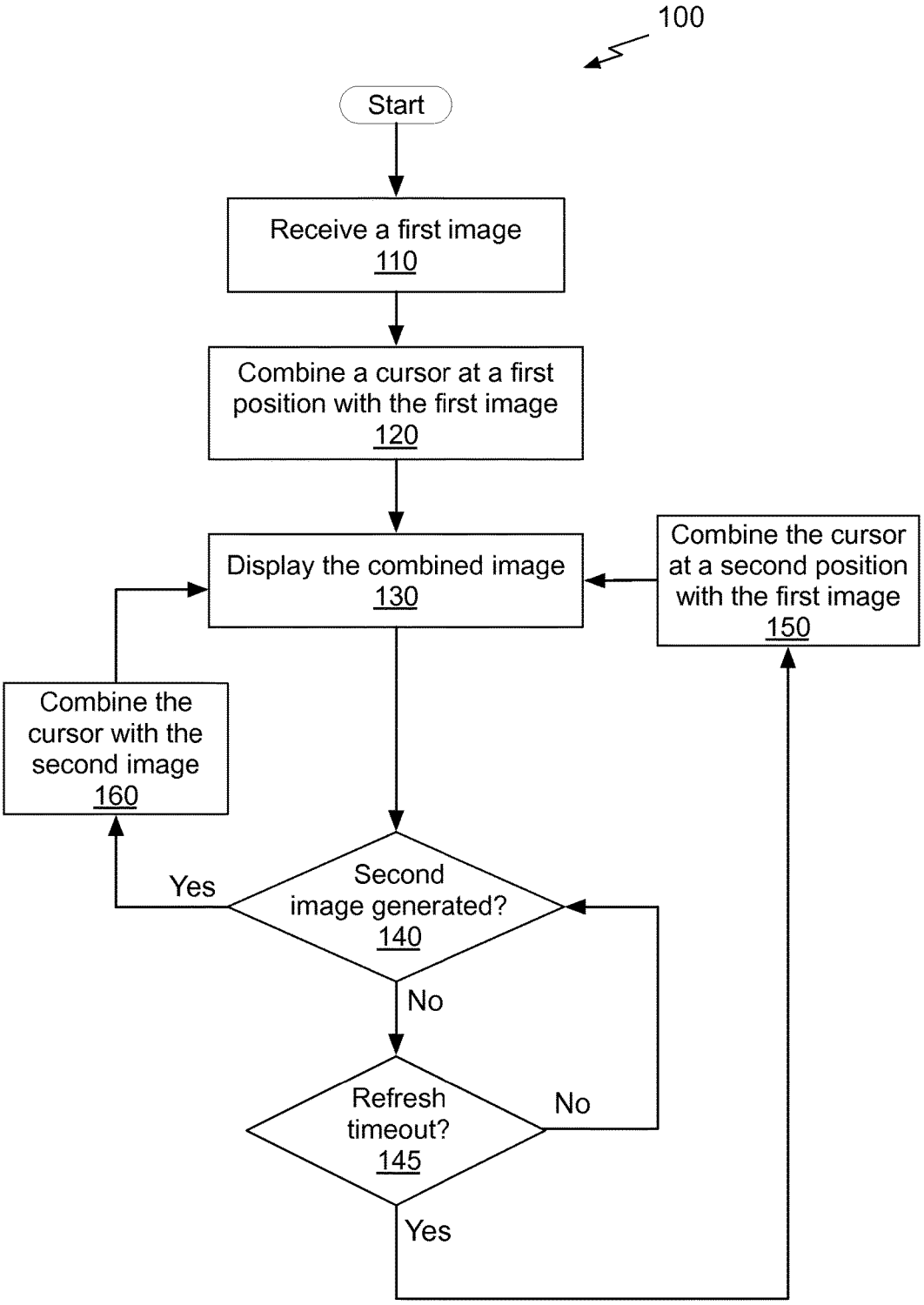
FIG. 1 illustrates a flowchart of a method for presenting an image and cursor on a dynamic refresh frequency capable display device, in accordance with one embodiment.

FIG. 1 illustrates a flowchart of a method 100 for repeating presentation of an image on a display device, in accordance with one embodiment. At step 110, a first image is received. In the context of the following description, the first image, and subsequent images, may be generated by a GPU that is configured to render a two or three-dimensional scene to produce an image for display. The first image is a complete image intended to fill the display screen of a display device and the first image may be read from a frame buffer. In most variable refresh rate display devices, the arrival time of each new image will be unknown as the rendering rate of the images will vary based on the complexity of the scene being rendered. The only way the arrival time of each new image will be known is if there is a one frame delay before transmitting the previous frame to the display device such that the rendering time for the current frame is known when the previous frame is sent to the display device. However, such delay may introduce a lag that could be noticeable to some users in interactive applications such as computer games.

At step 120, a cursor at a first position is combined with the first image to produce a first combined image. The first position may correspond to a position of a mouse or other pointer input device that is operated by a user. The first position may be specified in screen coordinates. In the context of the following description an image of a cursor is represented as a bitmap, sprite, or the like. In one embodiment, the cursor image may change depending on the portion of the input image over which the cursor image is composited or overlaid. For example, the representation of the cursor may change to represent the cursor is over an interactive element associated with an application. In the context of the following description, the cursor image (i.e., cursor) is combined with the first image using an overlay or compositing technique. Importantly, the cursor is not rendered as part of the first image. Instead, the cursor is independent of the first image and other subsequent images rendered by the GPU and stored in the frame buffer. Consequently, the first image may be static while the cursor position changes and conversely, the images may change while the cursor position is static.

At step 130, the combined image is displayed by a variable refresh rate display device. A minimum and a maximum refresh frequency may be defined for the variable refresh rate display device. It will be appreciated that, given a specified lower bound for the refresh frequency of a display device that corresponds to a maximum allowed frame duration and a specified upper bound for the refresh frequency of the display device that corresponds to a minimum allowed frame duration. The refresh timeout ensures that the minimum refresh frequency is met and is less than or equal to the inverse of the minimum refresh frequency (i.e., the maximum allowed frame duration). The frame duration is associated with the display device whereas an image duration is associated with the GPU. The frame duration is the amount of time that an image is displayed before the display device is refreshed. The image duration is the amount of time during which an image is rendered by the GPU. The image duration may also include the amount of time needed to store the image into a frame buffer. The image duration may vary for one or more images in a sequence of images.

The refresh timeout associated with the variable refresh rate display device may be computed based on one or more of a cursor redraw rate, an image rendering rate at which images are rendered by the GPU (i.e., the inverse of the image duration), a target frame rate specified by a user or environmental conditions (e.g., power consumption, temperature, etc.). The rate at which the cursor should be redrawn may be fixed or variable. For example, when the position of the cursor is changing quickly, the cursor redraw rate may be high and the refresh timeout may be set to a lower value. Conversely, when the position of the cursor is changing slowly, the cursor redraw rate may be low and the refresh timeout may be set to a higher value. In one embodiment, the cursor redraw rate is variable and the refresh timeout is computed based on the cursor redraw rate to redraw the cursor whenever the cursor position changes by a threshold amount. The threshold amount may be fixed or defined relative to the display device resolution. The cursor redraw rate may be higher or lower than the image rendering rate at which new images are generated by the GPU.

One such consideration when defining a refresh timeout is a trade-off between image quality and the chance of a collision between repeating the previous frame of image data while simultaneously receiving the current frame of image data. Most display devices do not have a way to abort an on-going presentation of an image. So, if a new image is received while a previous image is being refreshed, then the previous image must be fully presented before the new image can be presented on the display device. The delay between receiving the current frame of image data and finishing the presentation of the previous frame of image data may result in some amount of noticeable stutter in the resulting video stream. Higher dynamic refresh frequencies associated with higher repetition values will increase the chance of collisions, but higher dynamic refresh frequencies are typically associated with higher quality video. Therefore, there is a trade-off between selecting the highest possible dynamic refresh frequency and the chance of introducing some amount of stutter.

At step 140, if a second image is determined to have been generated, then at step 160, the cursor is combined with the second image to produce a combined image for display. Otherwise, the method proceeds to step 145. At step 145, if a refresh timeout associated with the variable refresh rate display device is determined to not have occurred, step 140 is repeated. If, at step 145, a refresh timeout associated with the variable refresh rate display device is determined to have occurred, the method proceeds to step 150. The refresh timeout is computed to be equal to or less than the maximum allowed frame duration specified for the variable refresh rate display device. In one embodiment, steps 140 and 145 are performed in parallel instead of in sequence.

A waiting step (not shown in FIG. 1) may be inserted between steps 130 and 140 to ensure that the maximum refresh frequency is not exceeded. The waiting step simply waits for a minimum time after display of the combined image in step 130 is started (i.e., a first pixel or first scanline is drawn) before proceeding to step 140. The minimum time should be equal to or greater than the inverse of the maximum refresh frequency and less than the refresh timeout.

At step 150, the cursor at a second position is combined with the first image to produce a second combined image for display. In other words, presentation of the first image is repeated with the cursor updated from the first position to the second position. The second position may be the same as the first position or the second position may different than the first position. In one embodiment, a display controller within the GPU may retransmit the first image (i.e., previous frame of image data) to the display device with the cursor at an updated position (i.e., the second position) by re-encoding the pixel data for the previous frame of image data with the cursor at the updated position in the video signal. In another embodiment, the display device may store the previous frame of image data locally, and the display device, either through a scaling unit or a timing controller, may cause the screen of the display device to refresh the pixels with the previous frame of image data and the cursor at successively updated positions a number of times.

In most variable refresh rate displays, the arrival time of each new frame of image data is unknown, and a heuristic based on past events may be used to estimate the arrival time of the next frame of image data. The estimated arrival time may be utilized to find a number of times the previous frame of image data should be refreshed on the display device in order to ensure that the display device is operating within specifications provided by the display device as to a minimum and maximum refresh frequency of the display device. The estimated arrival time is a next image duration representing the time required to render the next image data (e.g., second image) into a frame buffer and, consequently, the time that the current image data (first image) will be displayed by the display device while waiting for the next image data to be received. Importantly, as previously explained, the frame duration is independent of the image duration. The frame duration corresponds to the frame rate, and the frame rate is defined the rate at which the display is refreshed with the combined image data that may, or may not, have changed. The image duration may be faster or slower than the cursor duration needed to provide an interactive experience. The cursor duration is the time between when the cursor is redrawn (i.e., the inverse of the cursor redraw rate). When the cursor duration is less than the image duration, the frame rate equals the cursor redraw rate. When the cursor duration is greater than the image duration, the frame rate equals the image rate. The refresh timeout may be based on both the cursor duration and the estimated image duration. For example, the refresh timeout may be the lesser of the cursor duration and the estimated image duration.

In one embodiment, the refresh timeout may be computed based on the estimated next image duration and/or the image duration of one or more previous images. For example, the refresh timeout may be computed so that repeated frames are spaced equidistantly between each new image while also satisfying a minimum cursor redraw rate. In one embodiment, a timing controller in the display device calculates an estimate for the next image duration and/or the refresh timeout. In another embodiment, a scaling unit in the display device calculates an estimate for the next image duration and/or the refresh timeout. In yet another embodiment, a processor external to the display device, such as a graphics processing unit, calculates an estimate for the next image duration and/or the refresh timeout.

More illustrative information will now be set forth regarding various optional architectures and features with which the foregoing framework may or may not be implemented, per the desires of the user. It should be strongly noted that the following information is set forth for illustrative purposes and should not be construed as limiting in any manner. Any of the following features may be optionally incorporated with or without the exclusion of other features described.

Figure 2:
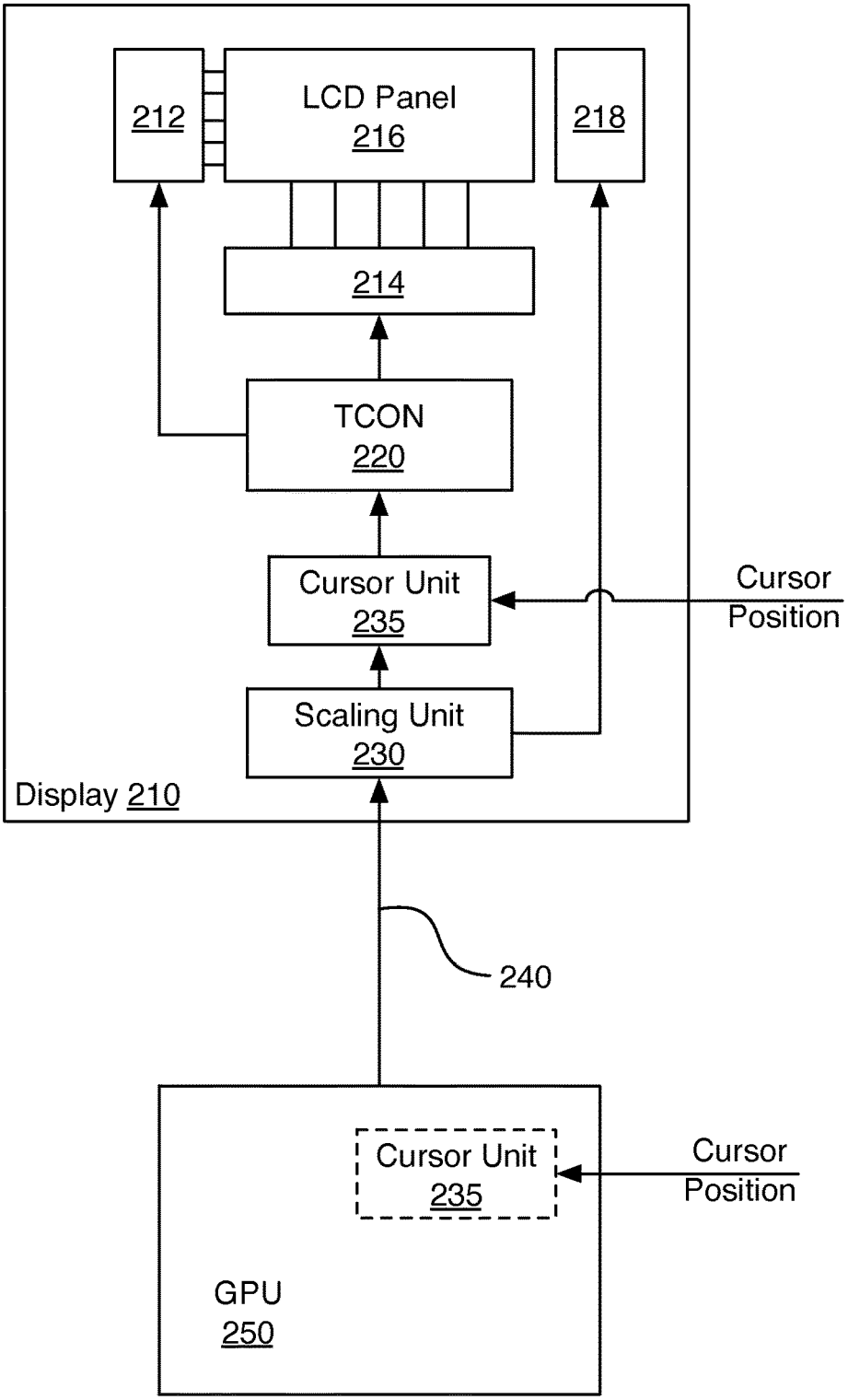
FIG. 2 illustrates a system that includes a dynamic refresh frequency capable display, in accordance with one embodiment.

FIG. 2 illustrates a system 200 that includes a dynamic refresh frequency capable display 210, in accordance with one embodiment. A GPU 250 may render frames of image data based on 3D primitives defined by an application executing on a CPU (not explicitly shown). The frames of image data may include pixel data stored in a frame buffer, which is a portion of memory allocated to store pixel data that is utilized to generate a video signal transmitted over a video interface 240. In one embodiment, the GPU 250 may be associated with a dual frame buffer (or ping-pong buffer) that includes a first portion of the frame buffer that stores pixel data for a previously rendered frame that is read out of memory and encoded within the video signal transmitted via the video interface 240 and a second portion of the frame buffer that stores pixel data for the current frame being rendered by the GPU 250. Once the GPU 250 has completed rendering of the current frame, the roles of the first portion of the frame buffer and the second portion of the frame buffer may be switched such that the second portion of the frame buffer stores pixel data for the recently rendered frame that is read out of memory and encoded within the video signal transmitted via the video interface 240 and the first portion of the frame buffer stores pixel data for the next frame being rendered by the GPU 250. The roles of the first and second portion of the frame buffer may alternate after each frame is rendered.

As shown in FIG. 2, the GPU 250 may include a cursor unit 235 that is configured to receive a cursor position and combine a cursor image with the image data for the current frame to produce combined image data that is encoded with the video signal transmitted via the video interface 240. In some embodiments, the cursor unit 235 is omitted from or disabled in the GPU 250 and instead included within the display 210 as also shown in FIG. 2. The cursor image may be stored in a memory within the GPU 250, the display 210, or in a separate memory. The cursor image is composited or overlaid with the pixel data based at the cursor position to produce the combined image that is encoded. When the cursor unit 235 is included within the display 210, the image data is transmitted via the video interface 240.

In one embodiment, the display 210 includes an LCD panel 216 that includes a plurality of pixel elements, each pixel element comprising a plurality of liquid crystal elements corresponding to a plurality of color components (e.g., a red component, a green component, and a blue component). The display 210 may also include row drivers 212 and column drivers 214 for controlling each of the pixel elements in the LCD panel 216. The row drivers 212 and column drivers 214 enable each individual pixel element in the LCD panel 216 to be addressed and each liquid crystal element of the pixel element to have a voltage applied thereto in order to vary a level of the corresponding color component displayed by the pixel element.

The display 210 also includes a backlight 218, which may comprise one or more compact fluorescent lights (CFLs) arranged around the edge or edges of the LCD panel 216, one or more LEDs arranged around the edge or edges of the LCD panel 216, or an array of LEDs arranged behind the pixel elements of the LCD panel 216. It will be appreciated that, in some embodiments, the display 210 may be an OLED panel or AMOLED panel that does not include the backlight 218.

The display 210 may also include the cursor unit 235, a timing controller (TCON) 220, and a scaling unit 230. The TCON 220 controls the row drivers 212 and the column drivers 214 in order to display the frames of image data on the LCD panel 216. When the cursor unit 235 is included within the display 210, the cursor unit 235 is omitted from the GPU 250 or the cursor unit 235 in the GPU 250 is disabled. The cursor unit 235 is configured to receive a cursor position and combine the cursor image with the image data received from the GPU 250 via the video interface 240 to produce combined image data. The scaling unit 230 receives the video signal from a GPU 250 via the video interface 240. In one embodiment, the video interface 240 is configured to transmit one or more of image data, a cursor image, and a cursor position. In one embodiment, when the cursor unit 235 is included within the display 210, the cursor position is received via the video interface 240. The video signal may correspond to a particular video signal format, such as a digital video signal format or an analog video signal format. Exemplary digital video signal formats include DVI (Digital Visual Interface), HDMI (High-Definition Multimedia Interface), and the like. Exemplary analog video signal formats include NTSC (National Television System Committee), PAL (Phase Alternating Line), VGA (Video Graphics Array), and the like.

The particular image data received via the video interface 240 may have a resolution that does not match a native resolution of the LCD panel 216. Thus, the scaling unit 230 is configured to scale the image frames encoded within the video signal to match the native resolution of the LCD panel 216. The scaling unit 230 may be configured to scale the images in the horizontal direction and/or the vertical direction. In one embodiment, the scaling unit 230 may filter the images. In yet another embodiment, where display 210 comprises a direct drive monitor or an LCD panel 216 included in a laptop computer, display 210 may not include a scaling unit 230.

The scaling unit 230 may also control the backlight 218. For example, the scaling unit 230 may determine a particular level of illumination the backlight 218 should provide for a given frame of image data and control the backlight 218 to provide the particular level of illumination. In an alternate embodiment, the display 210 may include a separate circuit that controls the backlight 218 such that the scaling unit 230 does not control the backlight 218.

Figure 3A:
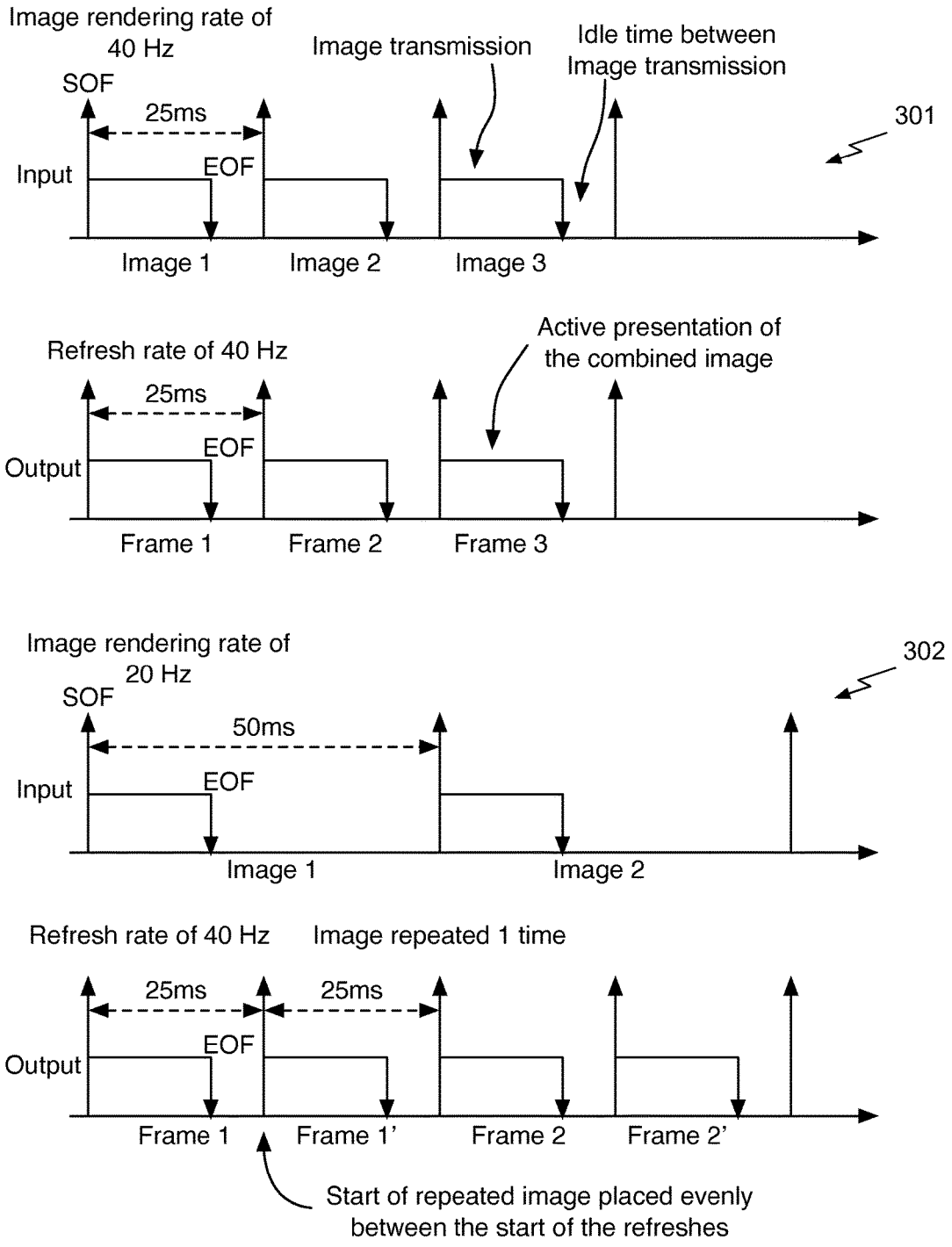
FIGS. 3A and 3B illustrate an example of image repetition with a minimum refresh frequency of 30 Hz, in accordance with one embodiment.
Figure 3B:
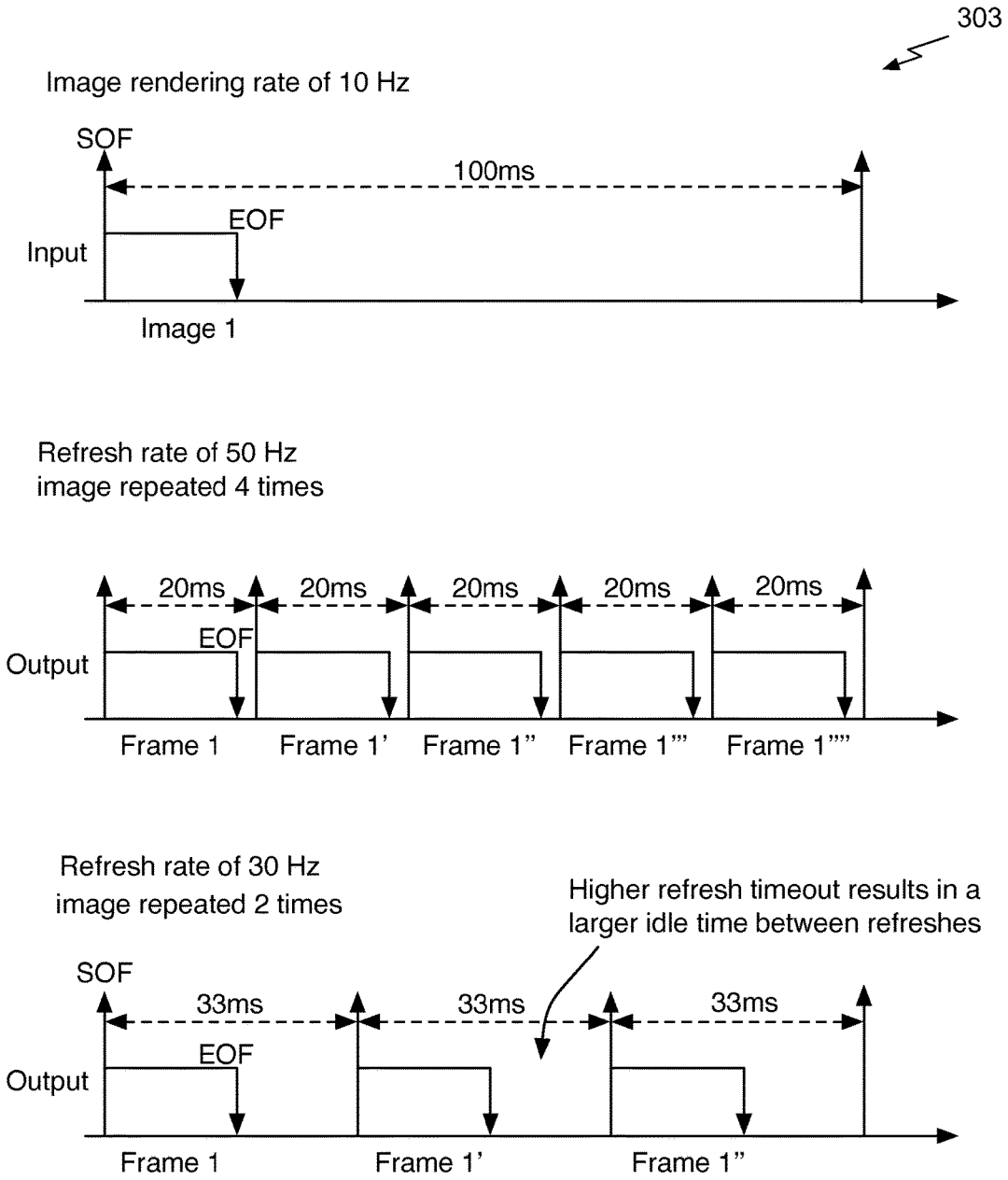

FIGS. 3A and 3B illustrate an example of image repetition with a minimum refresh frequency of 30 Hz, in accordance with one embodiment. A display device, such as display 210, may have a minimum refresh frequency of 30 Hz and a maximum refresh frequency of 125 Hz. In one embodiment, the refresh timeout is computed to be 25 ms, resulting in a refresh rate of 40 Hz. As shown in a first set of timing diagrams 301 in FIG. 3A, a sequence of images may be generated by the GPU 250.

In one embodiment, the GPU includes the cursor unit 235 and combines the image data with the cursor to produce the combined images that are transmitted to the display 210 via the interface 240. Each combined image is transmitted from the GPU 250 to the display 210 once. In another embodiment, as shown in FIGS. 3A and 3B, the image data may be transmitted to the display 210 via the interface 240 and the combined images may be generated by a cursor unit 235 within the display 210. Each new image need only be transmitted from the GPU 250 to the display 210 once. In the following description, the cursor unit 235 is included within the display 210 and the GPU 250 transmits the image data to the display 210 via the interface 240.

A current image is transmitted to the display 210 during a first portion of the next image duration. The "EOF" label represents an end-of-frame indicator in the video signal. The end-of-frame indicator makes clear that the entire image has completed transmission over the interface 240. The time between receiving the end-of-frame indicator for the current image and the start of the next image within the video signal may be referred to as idle time where image data is not received via the interface 240.

As shown in FIG. 3A, the first set of timing diagrams 301 includes an input signal. The input signal includes encoded data for three images received by the display 210, each image arriving approximately every 25 ms, which corresponds to a dynamic refresh rate of 40 Hz. The refresh timeout may be 40 ms or more. The refresh timeout should not be larger than a maximum allowed frame duration corresponding to the minimum refresh frequency that is specified for the LCD panel 216 (and the display 210). Because the images arrive every 25 ms and the refresh timeout is at least 40 ms, the images encoded within the video signal may be combined with the cursor and presented on the LCD panel 216 as the images are received, as illustrated by the output signal included in the first set of timing diagrams 301. In other words, none of the images need to be presented on the LCD panel 216 (i.e., refreshed) multiple times in order to satisfy the minimum refresh frequency specified for the display 210. A first, second, and third image (e.g., image 1, image 2, and image 3) are each combined with the cursor to produce combined images that are displayed as a first, second, and third frame (e.g., frame 1, frame 2, and frame 3).

In contrast, a second sequence of images may be generated by the GPU 250 at a lower rate. A second set of timing diagrams 302 in FIG. 3A includes an input signal that includes encoded data for two images received by the display 210, each image arriving approximately every 50 ms, which corresponds to an image rendering rate and dynamic refresh rate of 20 Hz. In one embodiment, the maximum allowed frame duration is 45 ms. Because the image duration of 50 ms is greater than the maximum allowed frame duration the received images need to be repeated. Therefore, a refresh timeout is calculated as 25 ms, so that each image will be repeated once halfway between when each new image is received. Each image encoded in the video signal will need to be presented on the LCD panel 216 multiple times, as illustrated by the output signal included in the second set of timing diagrams 302. In this example, each image (e.g., image 1 and image 2) is combined with the cursor twice to produce two frames (e.g., frames 1 and 1' and frames 2 and 2') so that the LCD panel 216 is refreshed at a dynamic refresh rate of 40 Hz, when compared to the image rendering rate of 20 Hz. Even though a new image is only received at 20 Hz, the cursor position and/or cursor image in the combined image may change at the refresh rate of 40 Hz. Therefore, a user perceives a more interactive experience compared with refreshing when the refresh timeout is based only on the minimum and maximum refresh frequencies of the display 210 and/or the image rendering rate.

As shown in FIG. 3B, in some instances the duration between consecutive images in the input signal may be so large that the images may need to be repeatedly combined with the cursor more than one time in order to meet the requirements of the minimum refresh frequency defined for the display 210. For example, as shown in the input signal included in a third set of timing diagrams 303, a next image duration may be 100 ms, which corresponds to a dynamic refresh frequency of 10 Hz. The next image duration of 100 ms is well above a maximum allowed frame duration corresponding to the minimum refresh frequency defined for the display 210. Therefore, a refresh timeout is computed as 20 ms so that each image is repeated a number of times. The refresh timeout of 20 ms results in a dynamic refresh rate of 50 Hz. A first output signal included in the third set of timing diagrams 303 shows the first image (e.g., image 1) being repeated four times and combined with the cursor to produce five frames (e.g., frames 1, 1', 1", 1''', and 1''''), corresponding to a dynamic refresh rate of 50 Hz. In another embodiment, the refresh timeout may be defined as 25 ms and the first image is repeated three times, resulting in a dynamic refresh rate of 40 Hz.

A second output signal included in the third set of timing diagrams 303 shows the first image being repeated two times and combined with the cursor, in order to satisfy the minimum refresh frequency, a refresh timeout is computed as 33 ms. The refresh timeout of 33 ms corresponds to a dynamic refresh rate of 30 Hz. Both output signals included in the third set of timing diagrams 303 meet the minimum and maximum refresh frequency requirements of the display 210.

Although not shown explicitly, other images may follow the images shown in the input signals in each of the three sets of timing diagrams. Furthermore, although each image is shown as being repeated in a manner associated with a constant dynamic refresh frequency, it will be appreciated that the time delay between images may be variable and the image for a particular input signal may be repeated a different number of times to accommodate varying dynamic refresh frequencies.

In one embodiment, a next image duration may be estimated using a heuristic based on past events, such as the known image duration times of one or more previous image durations. For example, the image duration associated with the previous image may be used to estimate the image duration associated with the next image. In another example, the average image duration associated with N previous images may be used to estimate the image duration time for the next image. The next image duration may be used to compute a refresh rate that approximately equally spaces the repeated images between each new image. A repetition value may be used to compute the refresh timeout. As shown in FIG. 3B, a repetition value of four corresponds to the refresh timeout of 20 ms and a repetition value of two corresponds to the refresh timeout of 33 ms. The smaller refresh timeout of 20 ms may be defined to satisfy a higher cursor redraw rate constraint. Thus, in one embodiment, both the cursor redraw rate and the estimated image duration is used to compute the refresh timeout.

In one embodiment, a repetition value for a previous image is computed based on the current image duration. It is always possible to determine an integer number of repetitions for an image such that the dynamic refresh frequency associated with the image falls within the lower and upper bounds for the refresh frequency of the display device as long as the following equation is met:

$$(\text{frame_duration}_{max}/\text{frame_duration}_{min}) \geq 2 \quad \text{(Eq. 1)}$$

In Equation 1, $\text{frame_duration}_{max}$ represents the maximum allowed frame duration of the display device and $\text{frame_duration}_{min}$ represents the minimum allowed frame duration of the display device. In other words, the magnitude of the maximum allowed frame duration should be greater than or equal to twice the magnitude of the minimum allowed frame duration. For example, if a display device has a lower bound for the refresh frequency of 50 Hz and an upper bound for the refresh frequency of 135 Hz, then the result of Equation 1 is approximately 2.7 (i.e., 20 ms/7.4 ms~2.7), which is greater than 2. If the images are generated too fast, then a delay may be added before transmitting the image data to the display device so that the refresh rate of the display device falls within the lower and upper bounds for the refresh frequency of the display device. However, if the images are generated too slowly, then the image data can be re-transmitted to the display device one or more times such that the dynamic refresh frequency of the display device falls within the lower and upper bounds for the refresh frequency of the display device. It will be appreciated that the time between each successive transmission of the images should be approximately even so that the intermediate delay between any two consecutive refreshes of the display device (i.e., the instantaneous dynamic refresh frequency) falls within the lower and upper bounds for the refresh frequency of the display device.

The actual number of times a particular image is repeatedly presented on the display device will depend on the rendering rate of the images as well as other considerations. For a given estimate of the current image duration, the maximum repetition value of a previous image may be computed as:

$$R_{max} = (\text{image_duration}_{curr}/\text{frame_duration}_{min}) \cdot \text{rounded_down} - 1 \quad \text{(Eq. 2)}$$

In Equation 2, $R_{max}$ is the maximum repetition value for the previous image, $\text{image_duration}_{curr}$ represents the current image duration, and $\text{frame_duration}_{min}$ represents the minimum allowed frame duration of the display device. The operator rounded_down simply rounds the intermediate result of the division operation down to the nearest integer value. By rounding down, the maximum repetition value represents an integer number of times that an image may be repeated within a given frame duration that corresponds to a dynamic refresh frequency below the upper bound for the refresh frequency of the display device.

Similarly, for a given estimate of the current image duration, the minimum repetition value of a previous image may be computed as:

$$R_{min} = (\text{image_duration}_{curr}/\text{frame_duration}_{max}) \cdot \text{rounded_up} - 1 \quad \text{(Eq. 3)}$$

In Equation 3, $R_{min}$ is the minimum repetition value for the previous image, $\text{image_duration}_{curr}$ represents the current image duration, and $\text{frame_duration}_{max}$ represents the maximum allowed frame duration of the display device. The operator rounded_up simply rounds the result of the division operation up to the nearest integer value. By rounding up, the minimum repetition value represents an integer number of times that an image frame may be repeated within a given frame duration that corresponds to a dynamic refresh frequency above the lower bound for the refresh frequency of the display device.

It will be appreciated that the maximum repetition value computed based on Equation 2 and the minimum repetition value computed based on Equation 3 do not include the initial presentation of the previous image on the display device and only represents the number of times the previous image should be repeatedly combined with the cursor to refresh the display device. In another embodiment, the "minus one" portion of Equations 2 & 3 may be removed such that the maximum repetition value and minimum repetition value represent a total number of times the previous image will be combined with the cursor to refresh the display device, including the initial presentation of the previous image as well as all subsequent presentations of the previous image.

The repetition value may be selected as any integer within the range of $[R_{min}, R_{max}]$, inclusive. In one embodiment, the repetition value is selected as the maximum repetition value. The maximum repetition value will correspond with the largest dynamic refresh frequency of the display device when repeating the refresh of the display device with a particular image an integer number of times within a given image duration, where the duration between any two successive refreshes is equally distributed. In another embodiment, the repetition value is selected as the minimum repetition value in order to minimize the chance of collisions with new images.

In yet another embodiment, the repetition value is selected as some value between the minimum repetition value and the maximum repetition value. The computed maximum repetition value or minimum repetition value do not necessarily have to be the actual number of times that the previous image is combined with the cursor to refresh the display device. In some cases, where there is a large disparity between the maximum allowed frame duration of the display device and the minimum allowed frame duration of the display device, there may be multiple integer values that represent the number of times an image could be repeated within a given duration where the resulting dynamic refresh frequency of the display device would fall within the lower and upper bounds for the refresh frequency of the display device. The actual number of repetitions chosen for an image may depend on other considerations, such as a cursor redraw rate.

In one embodiment, other considerations may include monitoring the frequency of collisions associated with previous images and decreasing the repetition value below the maximum repetition value once the frequency of collisions rises above a threshold value. In another embodiment, other considerations may include monitoring a variance in the image durations associated with a plurality of images and decreasing the repetition value below the maximum repetition value when the variance is above a threshold value. For example, for computer games that produce images with steady image duration (i.e., at a steady image rendering rate), the maximum repetition value may be optimal, but for computer games that produce images with erratic image duration, less than the maximum repetition value may be better.

Figure 4:
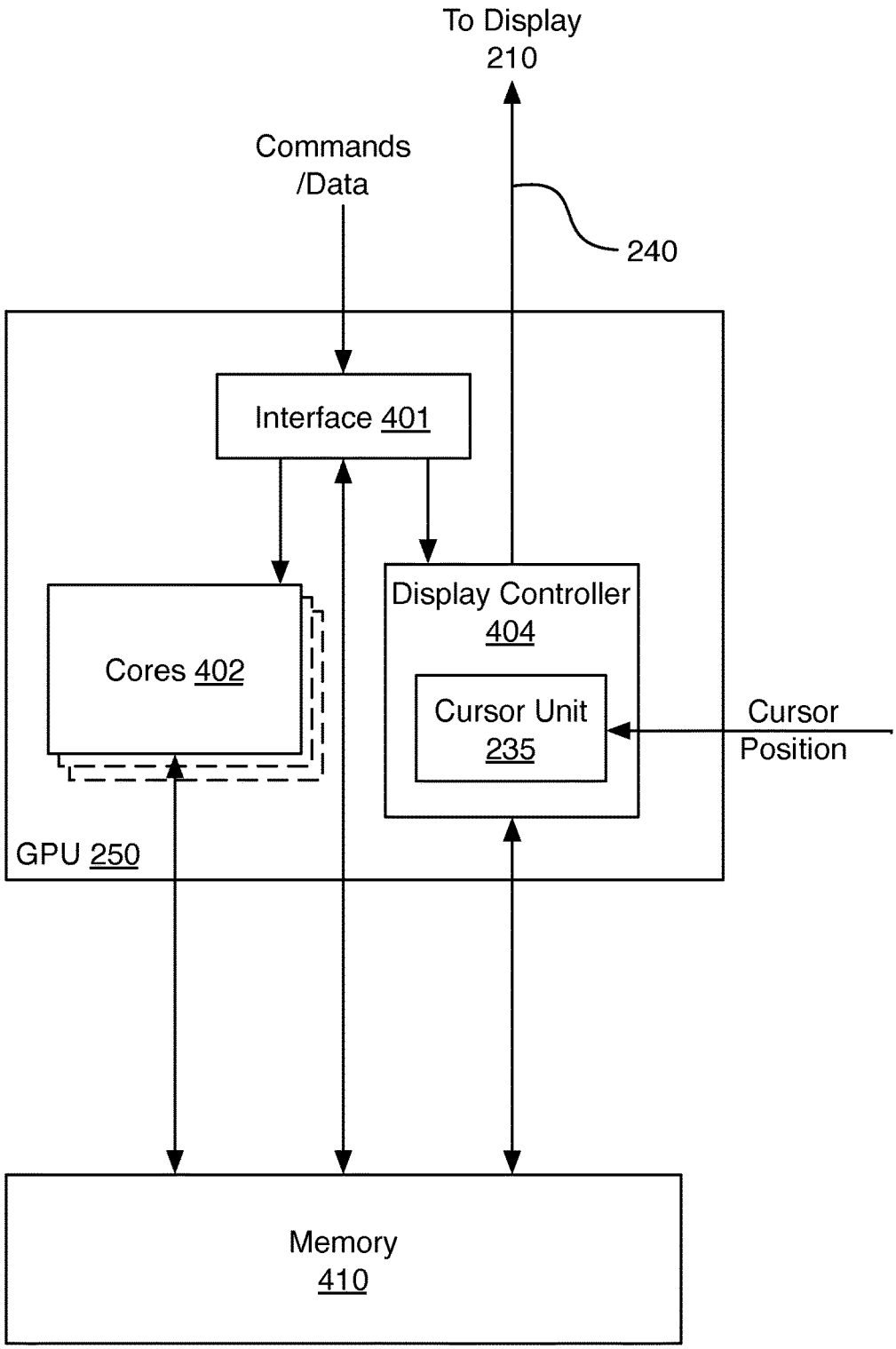
FIG. 4 illustrates the operation of the GPU of FIG. 2, in accordance with one embodiment.

FIG. 4 illustrates the operation of the GPU 250 of FIG. 2, in accordance with one embodiment. In one embodiment, the GPU 250 monitors the rendering rate of frames of image data generated by the GPU 250 and adjusts the effective dynamic refresh frequency of the display 210 by adjusting the refresh timeout. The GPU 250 may also adjust the refresh timeout based on a cursor redraw rate. The GPU 250 transmits each combined image to the display 210. In such an embodiment, the logic for adjusting the dynamic refresh frequency of the display 210 is implemented in the GPU 250, either within a dedicated hardware unit, a programmable logic unit executing instructions included in a software program, or some combination of hardware and software. In one embodiment, the cursor unit 235 is configured to adjust the refresh timeout that controls the dynamic refresh frequency of the display 210.

As shown in FIG. 4, the GPU 250 may be connected to a memory 410. The memory 410 may be a synchronous dynamic random access memory (SDRAM) configured to store data accessible to the GPU 250. In one embodiment, the memory 410 is a dedicated video memory that is only accessible by the GPU 250. In another embodiment, the memory 410 is a system memory that is shared between a CPU and the GPU 250.

The GPU 250 may receive commands and data from a CPU via the interface 401. The interface 401 may be, e.g., a PCIe (Peripheral Component Interconnect Express) interface that enables the GPU 250 to communicate with the CPU and/or a system memory via a bus (not explicitly shown). The GPU 250 may also include one or more cores 402 that process the data based on the commands. Each core 402 may be multi-threaded to process multiple data in parallel. In one embodiment, the cores 402 have a SIMD (Single-Instruction, Multiple Data) architecture. In SIMD architectures, a plurality of processing units process different data based on the same instruction. In another embodiment, the cores 402 have a MIMD (Multiple-Instruction, Multiple Data) architecture. In MIMD architectures, a plurality of processing units process different data based on different instructions scheduled on each processing unit. In yet another embodiment, the cores 402 have a SIMT (Single-Instruction, Multiple-Thread architecture. In SIMT architectures, a plurality of processing units process a plurality of related threads, each thread having the same instructions configured to process different data, but each thread capable of branching independently. In other words, individual threads may be masked to prevent execution of certain instructions in SIMT architectures. This enables conditional execution of the instructions associated with the plurality of threads. The GPU 250 may also include a display controller 404 that is configured to generate the video signal over the interface 240 according to the specification of a particular video signal interface. The display controller 404 may read the image data from a frame buffer in the memory 410 and provide the image data to the cursor unit 235. The cursor unit 235 is configured to receive a cursor position and combine a cursor image with the image data to produce combined image data. The display controller 404 then encodes the combined image data with the video signal transmitted via the video interface 240.

In one embodiment, the GPU 250 may be configured to implement one or more steps of the method 100 of FIG. 1. More specifically, the GPU 250 may render images based on commands and data received from a CPU over the interface 401. The GPU 250 may store the images in the frame buffer in the memory 410. Once the GPU 250 has completed rendering of each image, the frame buffer that stores pixel data for the rendered image is read out of memory, combined with the cursor to produce a combined image. After each combined image is generated, the GPU 250 may generate a video signal transmitted over the interface 240 to cause the combined image data to be presented on the display 210. Each image rendered to the frame buffer may be combined with the cursor one or more times in order to adjust the dynamic refresh frequency of the display 210.

The GPU 250 may combine the previous image with the cursor and encode the combined image into the video signal to cause an initial presentation of the previous image on the LCD panel 216 of the display 210. Instead of waiting for the current image to be completely rendered into the frame buffer in order to combine the next image with the cursor, the GPU 250 may determine whether the previous image should be repeated. In other words, the GPU 250 may be configured to estimate the current image duration associated with a current image being rendered into the frame buffer by the GPU 250 and then combine the previous image with the cursor based on the estimated current image duration. The GPU 250 may use a heuristic to estimate the current image duration. For example, the heuristic may be based on information related to the known image durations for one or more previous images. As used herein, the term "image duration" may refer to the time required for the GPU 250 to render the next image. The GPU 250 may estimate the current image duration using any available technique.

In one embodiment, the GPU 250 stores a timestamp associated with each image rendered to the frame buffer. For example, a last command associated with the rendering of each image may access a system clock and store a time represented by the system clock in a register, a local shared memory (e.g., Static RAM or SRAM included on the silicon substrate of the GPU 250), or an external memory such as the memory 410. The timestamps may be utilized to calculate a time between rendering any two images.

In one embodiment, the GPU 250 may determine an estimate for the current image duration by calculating a rendering time associated with the previous image. In one embodiment, the rendering time is calculated by subtracting a timestamp associated with the previous image from a timestamp associated with an image that immediately preceded the previous image. The rendering time required to render two adjacent images is similar when the content of the two images is similar and the processing of the content is similar—which is very often the case. Therefore, the rendering time for the previous image may provide a good estimate for the rendering time for the current image, which is representative of the current image duration.

In another embodiment, the GPU 250 may determine an estimate for the current image duration by calculating an average rendering time associated with N images. The average rendering time represents a moving average based on the rendering times associated with the last N images. The average rendering time, in this embodiment, may be calculated by finding a difference between a timestamp associated with an $N^{th}$ image in the plurality of images from a timestamp associated with the previous image in the plurality of images and dividing the difference by the value of N. It will be appreciated that the N images are N adjacent images and that the previous image is presented on the display 210 N−1 images after the $N^{th}$ image. The average rendering time may be selected as an estimate for the current image duration.

Other heuristics may be used to calculate an estimate for the current image duration. For example, the image duration associated with the previous image may be multiplied by a factor (e.g., 90%, 105%, etc.) to adjust the estimate of the current image duration to allow for slight variations in the rendering time between different images. Other methods for estimating the current image duration are contemplated as being within the scope of the present disclosure.

Once the GPU 250 has calculated an estimate for the current image duration, the GPU 250 may select a repetition value that falls within the minimum and maximum repetition values according to Equations 2 & 3, set forth above. In one embodiment, the GPU 250 may retrieve the minimum and maximum allowed frame durations of the display 210 from EDID (Extended Display Identification Data) information transmitted by the display 210 to the GPU 250 via the interface 240. In another embodiment, the GPU 250 may be associated with a driver that is configured to retrieve the minimum and maximum allowed frame durations for the display 210 from a memory. The minimum and maximum allowed frame durations may be entered manually by a user when configuring the driver, retrieved automatically via a network connection such as the Internet, or included in a database associated with the driver that associates different displays with different minimum and maximum allowed frame durations according to manufacturer specifications.

After the GPU 250 has calculated the refresh timeout based on at least the repetition value, the GPU 250, via the display controller 404, may transmit a combined image that includes the previous image and the cursor to the display 210 over the interface 240. The GPU 250 may repeatedly combine the previous image with the cursor based on the refresh timeout. In one embodiment, the GPU 250 combines the previous image with the cursor a number of times equal to the calculated repetition value.

It will be appreciated that the number of times that the previous image is to be combined with the cursor is unknown when the current image is being rendered because the final rendering time for the current image is unknown. The estimate for the current image duration is simply a guess as to how long the previous image will be used to produce one or more combined images that are presented by the display 210. When the current image duration is estimated incorrectly and the current image has been rendered to the frame buffer faster than expected, the previous image may not be combined with the cursor as many times as initially planned and the current image will be combined with the cursor and presented by the display 210 as soon as possible. Similarly, when the current image duration is estimated incorrectly and the current image has not been rendered to the frame buffer by the expected time, the previous image may be combined with the cursor more times than initially planned (i.e., more than the number of times given by the repetition value).

Figure 5A:
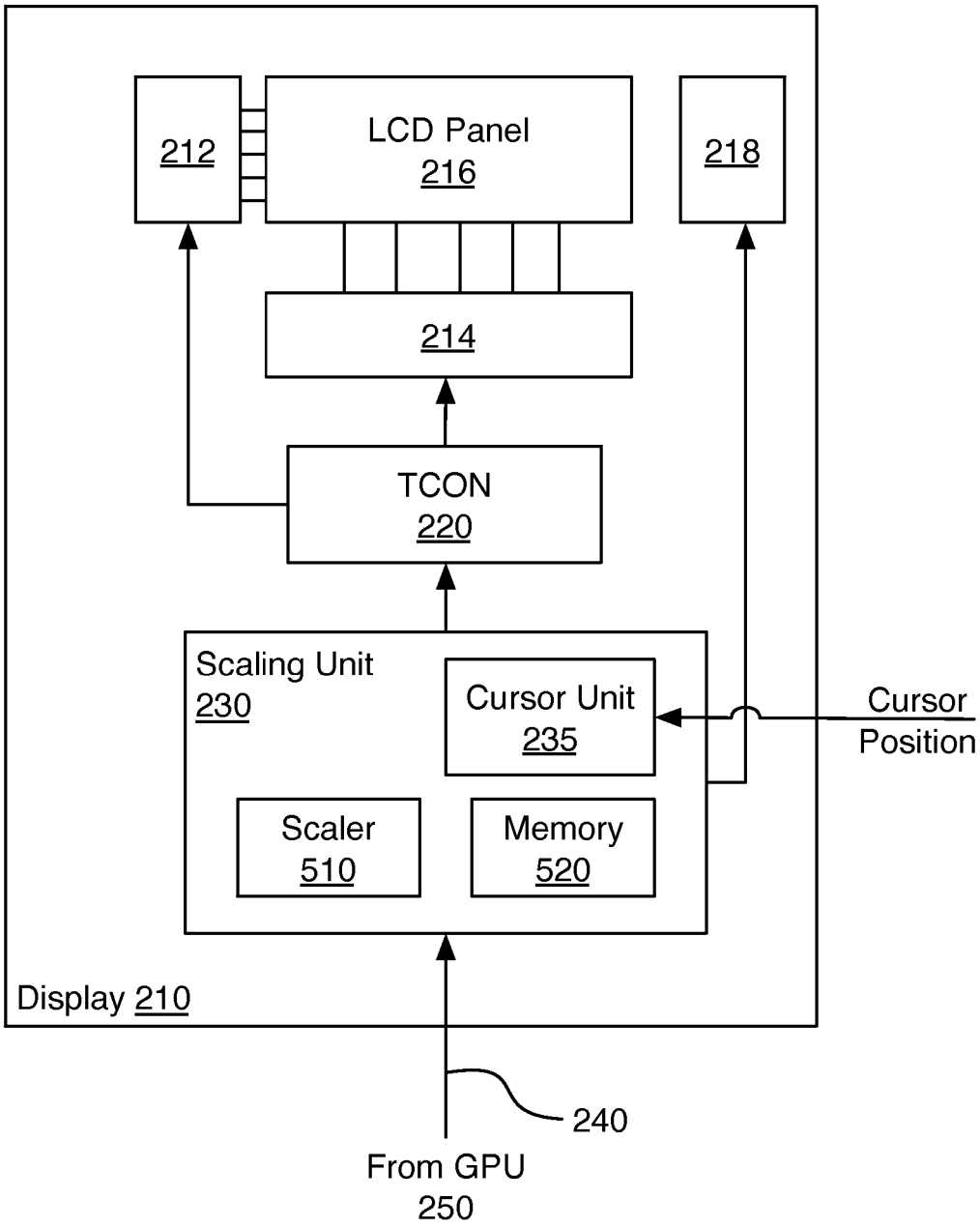
FIG. 5A illustrates the operation of the scaling unit of FIG. 2, in accordance with another embodiment.

FIG. 5A illustrates the operation of the scaling unit 230 of FIG. 2, in accordance with another embodiment. In another embodiment, the logic for ensuring that the display device refreshes the LCD panel 216 within the lower and upper bounds for the refresh frequency of the display device is implemented within the display device. For example, the display 210 may be configured to adjust the dynamic refresh frequency of the display 210 by repeatedly causing the LCD panel 216 to be refreshed by combining the image data for the previous image with the cursor in order to keep the dynamic refresh frequency within the lower and upper bounds for the refresh frequency of the display 210. In such an embodiment, the GPU 250 may simply transmit each image to the display 210 one time over the interface 240 and then the display 210 handles the logic for repeatedly combining the image with the cursor to produce one or more combined images. In one embodiment, the cursor unit 235 is implemented in the scaling unit 230.

Again, the scaling unit 230 is configured to scale the images encoded in the video signals received via the interface 240 to match a native resolution of the display 210. As shown in FIG. 5, the scaling unit 230 may include a scaler 510, a local memory 520, and the cursor unit 235. The scaling unit 230 may be a fixed function hardware unit embodied on an ASIC (application specific integrated circuit) included in the display 210. In another embodiment, the scaling unit 230 may be included on a larger ASIC that includes the TCON 220. In one embodiment, the local memory 520 includes on-chip DRAM used to store image data. In another embodiment, the local memory 520 includes a cache associated with off-chip DRAM accessible by the scaling unit 230 via an interface. Image data may be stored in the off-chip DRAM and fetched into the cache as needed.

The scaler 510 may receive each image at a resolution generated by the GPU 250. The scaler 510 may determine the resolution of the images by analyzing the video signal (i.e., counting the number of pixels between horizontal synchronization signals and/or vertical synchronization signals), or the scaler 510 may receive a configuration signal from the GPU 250 over the interface 240 that specifies a resolution of the images transmitted over the interface 240. The scaler 510 may then scale the images from the original resolution provided by the GPU 250 to the native resolution of the display 210. When the original resolution matches the native resolution, then no scaling of the images may be required. The scaled image data may be generated via, e.g., interpolating one or more values in the original image data to generate values for each pixel location in the scaled image data at the native resolution. The image data may be stored in the local memory 520 and filtered (e.g., interpolated, etc.) to generate scaled image data. The scaled image data is combined with the cursor by the cursor unit 235 and the combined images are output to the TCON 220 to be displayed on the LCD panel 216.

In one embodiment, the cursor unit 235 is also configured to manage dynamic frame repetition based on the minimum and maximum allowed frame durations of the display 210. The display 210 may be configured to ensure that the LCD panel 216 is refreshed at a rate that falls between the lower and upper bounds for the refresh frequency of the display, even though the incoming video signal may not adhere to these requirements. In such an embodiment, the GPU 250 may be configured to simply transmit the image data to the display 210 when the image data have been fully rendered into the frame buffer. Image data for each image may only be transmitted to the display 210 one time. Once the scaling unit 230 has caused a previous image to be presented on the LCD panel 216, the scaling unit 230 may calculate an estimate for the current image duration.

In one embodiment, the scaling unit 230 determines the image durations associated with each image included in the video signal by calculating a delay between the start of each image received by the scaling unit 230 via the interface 240, utilizing, e.g., a system clock included in the display 210 and timestamps associated with the images stored in the memory 420. The start of each image may be characterized by a vertical synchronization signal included in the video signal that cause the display 210 to store a timestamp in the memory 420 that indicates a time associated with the start of that image.

In another embodiment, the GPU 250 transmits metadata associated with each image that includes the image duration for the previous image in the video signal transmitted via the interface 240. The scaling unit 230 reads the image durations from the video signal and determines an estimate for the current image duration based on one or more image durations received in the video signal. Once the scaling unit 230 has determined an estimate for the current image duration, the cursor unit 235 may calculate a refresh timeout. The refresh timeout will control the number of times that the previous frame of image data is repeated.

Then the cursor unit 235 may cause the scaled image data for the previous image to be repeatedly combined with the cursor. The number of times the cursor unit 235 combines the scaled image data for the previous image with the cursor depends on the refresh timeout value. Again, if the estimate for the current image duration calculated by the scaling unit 230 is incorrect (i.e., the next image is received via the interface 240 either before or after the estimated arrival time), then the cursor unit 235 may combine the scaled image data for the previous image with the cursor either a fewer or greater number of times than initially planned based on the estimated image duration.

Figure 5B:
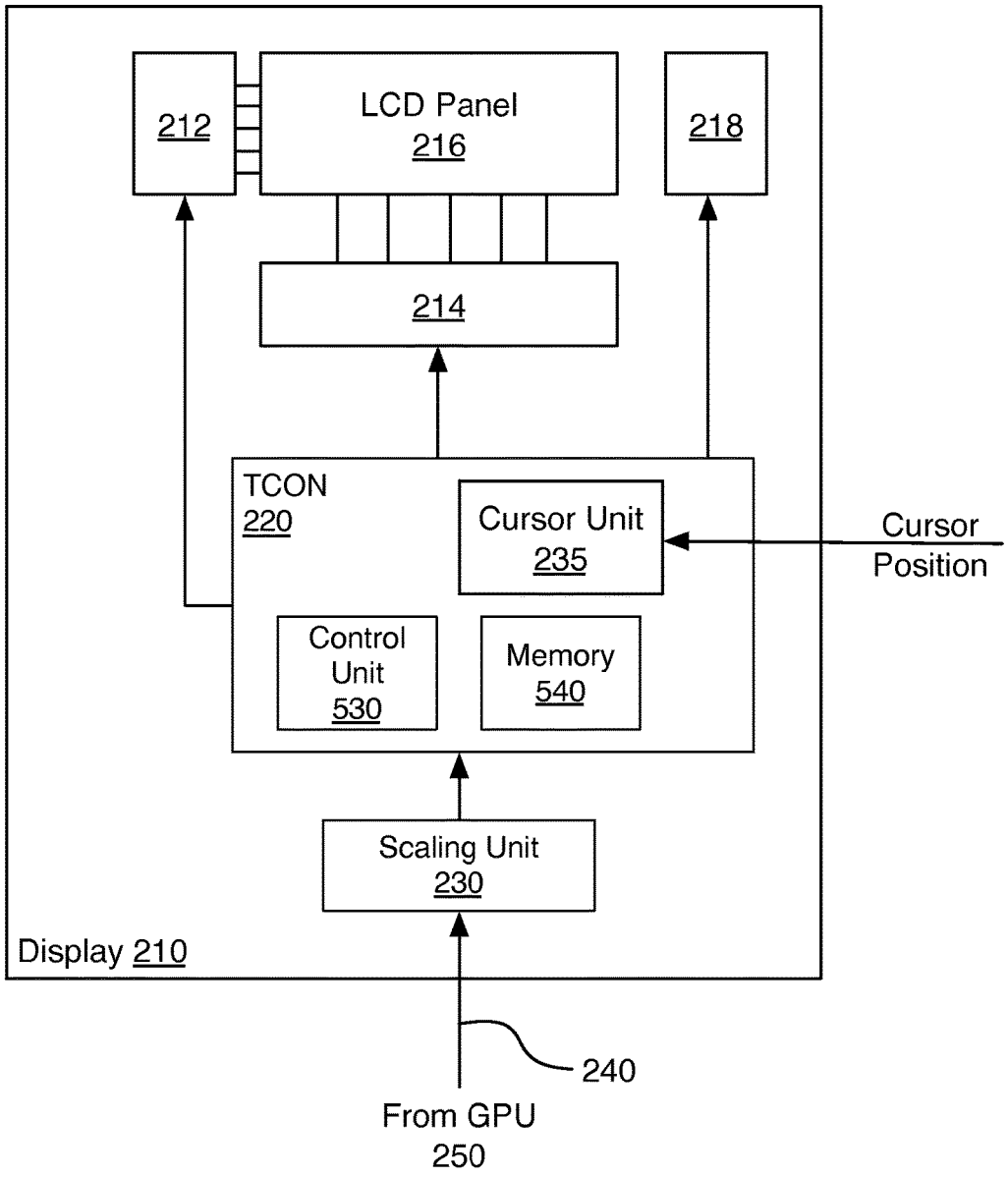
FIG. 5B illustrates the operation of the TCON of FIG. 2, in accordance with another embodiment.

FIG. 5B illustrates the operation of the TCON 220 of FIG. 2, in accordance with another embodiment. In yet another embodiment, the logic for ensuring that the display device refreshes the LCD panel 216 within the lower and upper bounds for the refresh frequency of the display device (i.e., the cursor unit 235) is implemented within the TCON 220 instead of the scaling unit 230.

The TCON 220 includes the cursor unit 235, a control unit 530, and memory 540. The memory 540 may include DRAM and/or registers. The TCON 220 may be a fixed function hardware unit embodied on an ASIC (application specific integrated circuit) included in the display 210. In another embodiment, the TCON 220 may be included on a larger ASIC that includes the cursor unit 235 and the scaling unit 230. The control unit 530 is configured to transmit signals to the row drivers 212 and column drivers 214 based on the scaled image data received from the scaling unit 230. The TCON 220 receives a combined image from the cursor unit 235, where the combined image data is received in, e.g., row major order one component value at a time. The cursor unit 235 combines the cursor with scaled image data received from the scaling unit 230. The control unit 530 then addresses specific pixels utilizing the row drivers 212 and column drivers 214 to change the value of each pixel in the LCD panel 216 based on the combined image data.

Once the TCON 220 has caused the combined data for the previous image to be presented on the LCD panel 216, the TCON 220 may calculate an estimate for the current image duration in a similar fashion to the manner implemented by the scaling unit 230, described above. In other words, the TCON 220 may calculate delay times between receiving each scaled image data from the scaling unit 230 and then estimate the current image duration based on the delay times associated with one or more previous scaled images. The cursor unit 235 may then use this estimate of the current image duration to calculate the refresh timeout. The refresh timeout may be calculated based on a cursor redraw rate and/or a repetition value. Finally, the refresh timeout may cause the previous scaled image to be repeatedly combined with the cursor and presented on the LCD panel 216.

In one embodiment, the TCON 220 may be associated with a refresh buffer that stores the scaled image data for the previous image as the scaled image data is received from the scaling unit 230. The refresh buffer may be implemented on the ASIC in memory 540. In another embodiment, the refresh buffer may be implemented in off-chip memory accessible by the TCON 220 via a cache in memory 540 and a memory interface. For example, the refresh buffer may be implemented within an external DRAM and portions of the refresh buffer may be fetched into a cache in memory 540 as needed. The stored scaled image data may then be read by the TCON 220 in order to combine the previous image with the cursor one or more additional times and present the combined image(s) on the LCD panel 216.

Alternatively, the refresh buffer may be managed by the scaling unit 230. Instead of reading the scaled image data from a memory accessible by the TCON 220, the TCON 220 may be configured to transmit a signal to the scaling unit 230 that causes the scaling unit 230 to retransmit the scaled image data for the previous image to the TCON 220 such that the previous image is combined with the cursor. In other words, the memory 520 associated with the scaling unit 230 may be utilized to implement the refresh buffer instead of storing the scaled image data redundantly.

Figure 6A:
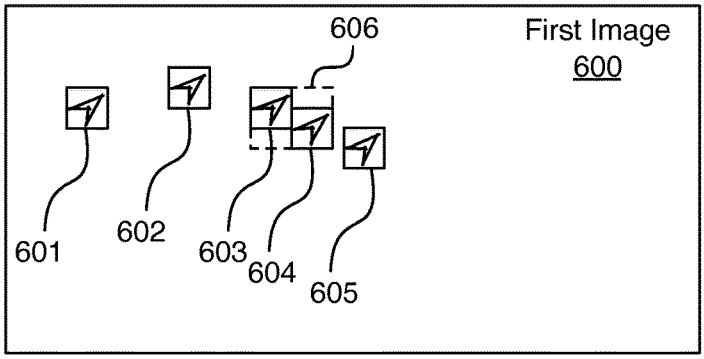
FIG. 6A illustrates an example of a first image combined with a cursor at multiple positions, in accordance with one embodiment.

FIG. 6A illustrates an example of a first image 600 that is combined with a cursor at multiple positions 601, 602, 603, 604, and 605, in accordance with one embodiment. The cursor unit 235 combines the first image 600 with the cursor at a first position 601 to produce a first combined image. When a refresh timeout occurs, the cursor unit 235 then combines the first image 600 with the cursor at a second position 602 to produce a second combined image. When another refresh timeout occurs, the cursor unit 235 combines the first image 600 with the cursor at a third position 603 to produce a third combined image. When yet another refresh timeout occurs, the cursor unit 235 combines the first image 600 with the cursor at a fourth position 604 to produce a fourth combined image. Finally, when a last refresh timeout occurs, the cursor unit 235 combines the first image 600 with the cursor at a fifth position 605 to produce a fifth combined image. The first, second, third, fourth, and fifth combined images are displayed in succession at the dynamic refresh frequency determined by the refresh timeout.

In one embodiment, the display 210 may be configured to refresh a cursor region of the screen including one or more pixels or scanlines instead of refreshing the entire screen. Rather than redrawing each pixel of the display 210, only portions of the combined image that have changed relative to the previous combined image may be redrawn. For example, a cursor region 606 may be refreshed to display the fourth combined image. Redrawing the cursor region 606 will "erase" the cursor at position 603 and draw the cursor at the position 604. To display the second combined image, the refresh operation may draw two non-contiguous regions or the screen, i.e., a first region encompassing the cursor at position 601 and a second region encompassing the cursor at position 602. The cursor region that is redrawn to display the second combined image includes at least pixels in the first and second regions.

Figure 6B:
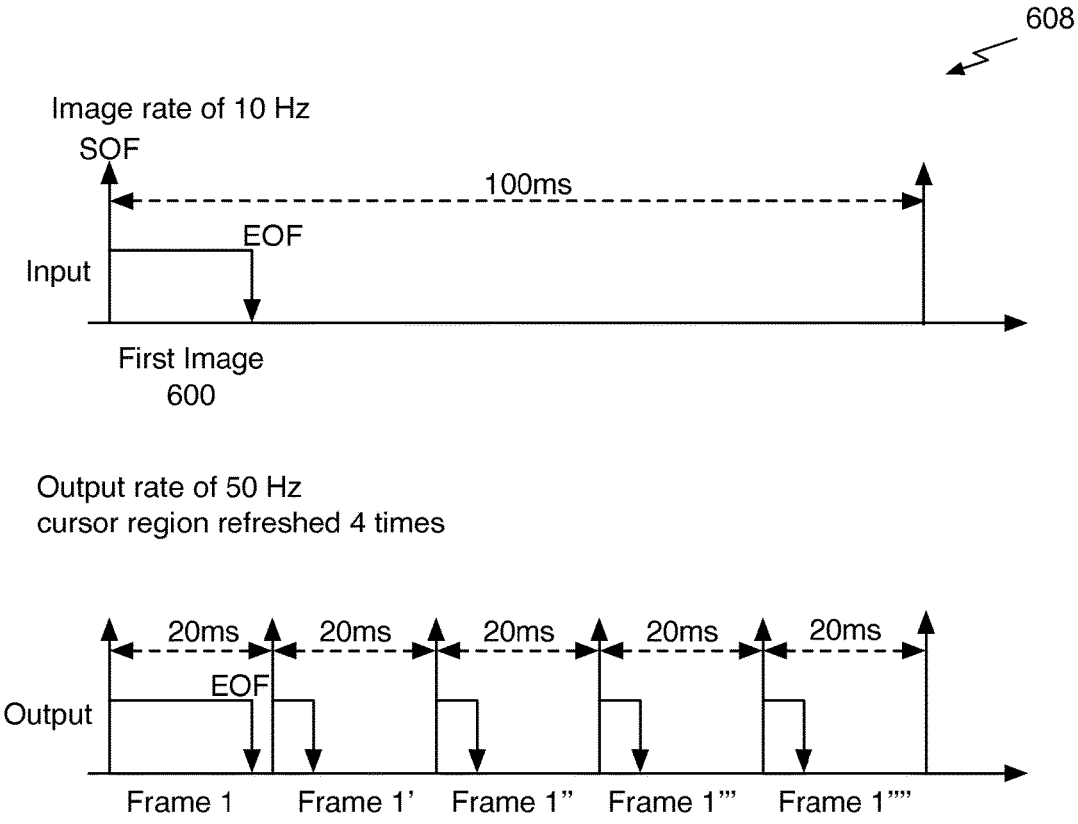
FIG. 6B illustrates an example of variable display refresh with a minimum refresh frequency of 50 Hz, in accordance with one embodiment.

FIG. 6B illustrates an example of variable display refresh with a minimum refresh frequency of 50 Hz, in accordance with one embodiment. A display device, such as display 210, may have a minimum refresh frequency of 30 Hz and a maximum refresh frequency of 125 Hz. As shown in a first set of timing diagrams 608 in FIG. 6B, a sequence of images including the first image 600 may be generated by the GPU 250. The input signal includes encoded data for the first image 600 received by the display 210, each image arriving approximately every 100 ms, which corresponds to an image rendering rate of 10 Hz. In one embodiment, the refresh timeout is computed as 20 ms, resulting in a refresh rate of 50 Hz. Because the image duration of 100 ms is greater than the refresh timeout of 20 ms, the first image 600 will be repeated four times.

However, rather than refreshing the LCD panel 216 by redrawing a combination of the entire first image 600 and the cursor, each subsequent refresh (after Frame 1) is accomplished by refreshing the cursor region. In this example, the image 600 is combined with the cursor five times to produce five frames (e.g., frames 1, 1', 1", 1''', and 1'''') that correspond to the cursor positions 601, 602, 603, 604, and 605, respectively, so that the LCD panel 216 is refreshed at a dynamic refresh rate of 50 Hz, when compared to the image rendering rate of 10 Hz. Even though a new image is only received at 10 Hz, the cursor position and/or cursor image in the combined image may change at the refresh rate of 50 Hz. A cursor timeout may be defined that corresponds to the refresh rate corresponding to the desired cursor updates.

The amount of idle time between drawing pixels to the LCD panel 216 increases when only the cursor region is refreshed compared with refreshing the entire screen. Refreshing the cursor region may reduce the power consumption of the display 210. In some embodiments, because less time is needed to refresh only the cursor region, a faster refresh rate may also be used and the cursor may be perceived as more interactive to a user.

Figure 6C:
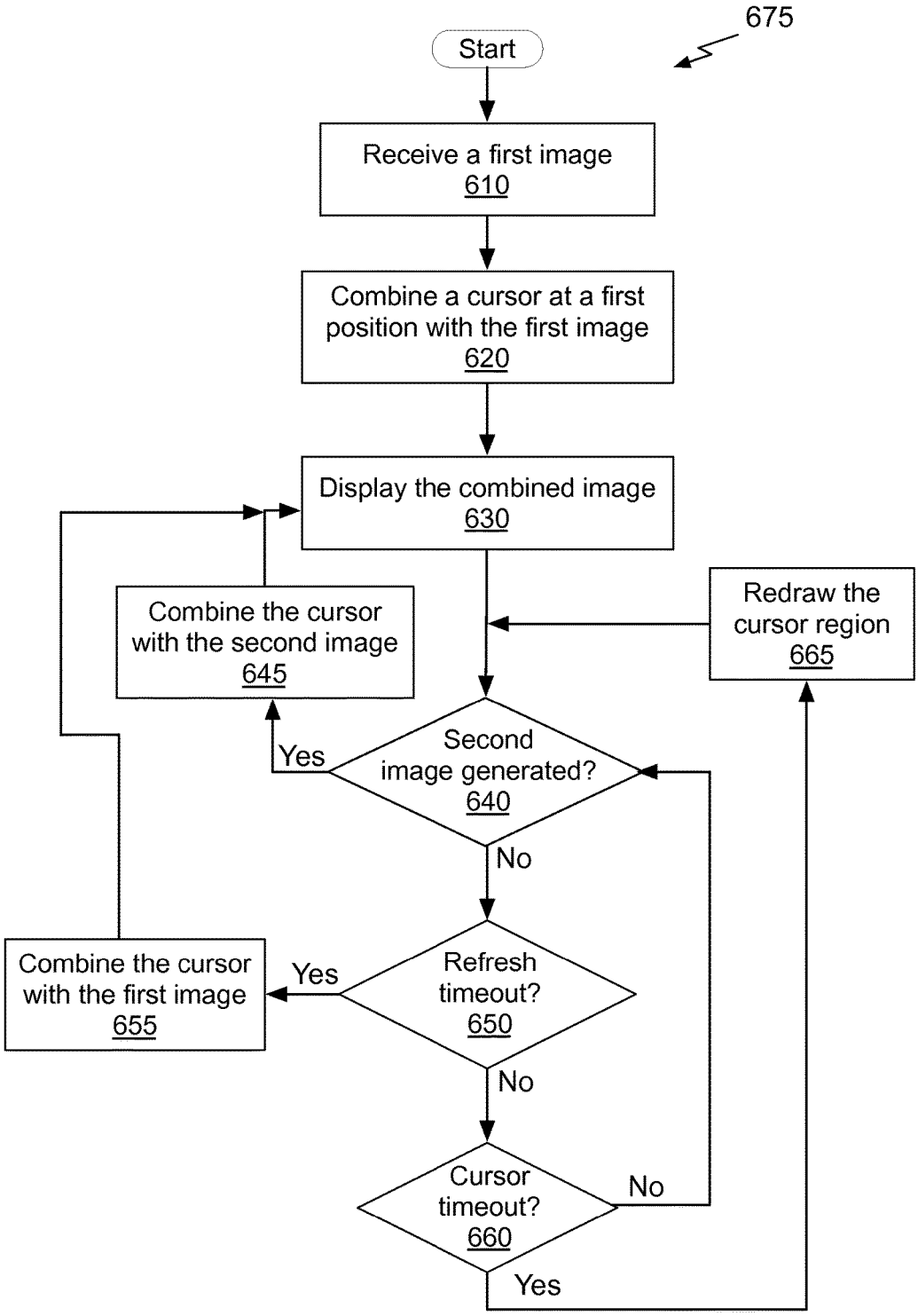
FIG. 6C illustrates a flowchart of a method for presenting an image and cursor on a dynamic refresh frequency capable display device, in accordance with one embodiment.

FIG. 6C illustrates another flowchart of a method 675 for presenting an image and cursor on a dynamic refresh frequency capable display device, in accordance with one embodiment. At step 610, a first image is received by the display 210. At step 620, a cursor at a first position is combined with the first image to produce a first combined image. At step 630, the first combined image is displayed by the variable refresh rate display 210.

At step 640, if a second image is determined to not have been generated, then, at step 650 the variable refresh rate display 210 determines if the refresh timeout associated with the variable refresh rate display 210 has occurred. If a refresh timeout has occurred, then at step 655, the cursor unit 235 combines the cursor with the first image to produce the second combined image for display and returns to step 630. Otherwise, if, at step 650, a refresh timeout associated with the variable refresh rate display device is determined to have not occurred, then at step 660, the variable refresh rate display 210 determines if the cursor timeout has occurred. If a cursor timeout has not occurred, then the variable refresh rate display 210 returns to step 640. Otherwise, at step 665, the display 210 redraws the cursor region and returns to step 640. In one embodiment, the cursor region is redrawn by generating a second combined image corresponding to the cursor region. The cursor unit 235 or the display 210 may be configured to generate the second combined image corresponding to the cursor region. The second combined image corresponding to the cursor region effectively erases the cursor at the previous position and draws the cursor at the current position.

A waiting step (not shown in FIG. 6C) may be inserted between steps 630 and 640 to ensure that the maximum refresh frequency is not exceeded. The waiting step simply waits for a minimum time after display of the combined image in step 630 is started or the cursor region is redrawn in step 665 before proceeding to step 640. The minimum time should be equal to or greater than the inverse of the maximum refresh frequency and less than the refresh timeout.

If, at step 640, a second image is determined to have been generated (i.e., received by the display 210), then at step 645, the cursor unit 235 combines the cursor with the second image to produce a third combined image for display and then returns to step 630. In one embodiment, one or more of steps 640, 650, and 660 are performed in parallel instead of in sequence.

It will be appreciated that, as described above, adjusting the dynamic refresh frequency of the display device based on the refresh timeout may be implemented by any one of the GPU 250, the scaling unit 230 of the display 210, or the TCON 220 of the display 210. Furthermore, the various embodiments described above may be implemented in the graphics processor 706 and display 708 of system 700, described below.

Figure 7:
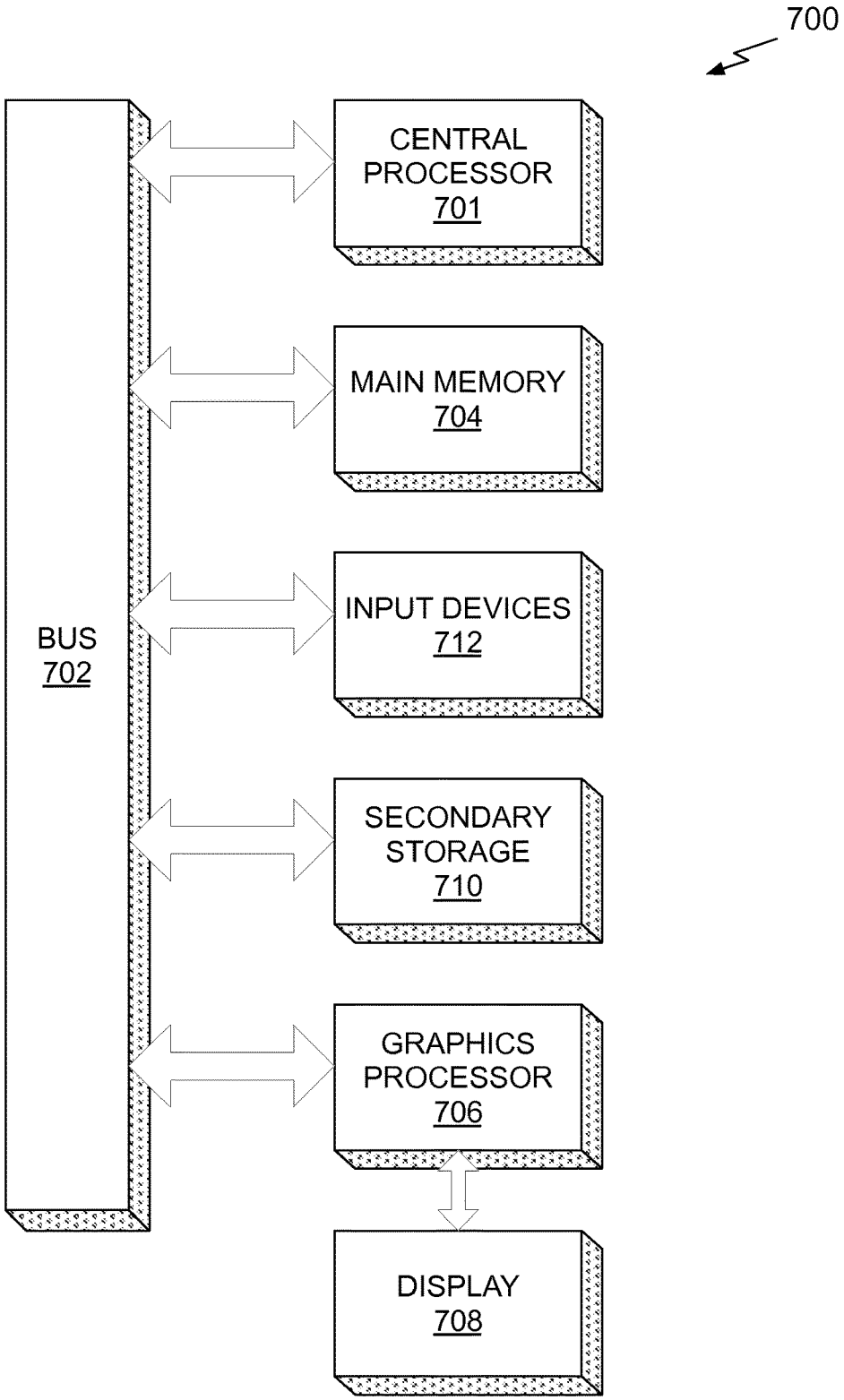
FIG. 7 illustrates an exemplary system in which the various architecture and/or functionality of the various previous embodiments may be implemented.

FIG. 7 illustrates an exemplary system 700 in which the various architecture and/or functionality of the various previous embodiments may be implemented. As shown, a system 700 is provided including at least one central processor 701 that is connected to a communication bus 702. The communication bus 702 may be implemented using any suitable protocol, such as PCI (Peripheral Component Interconnect), PCI-Express, AGP (Accelerated Graphics Port), HyperTransport, or any other bus or point-to-point communication protocol(s). The system 700 also includes a main memory 704. Control logic (software) and data are stored in the main memory 704 which may take the form of random access memory (RAM).

The system 700 also includes input devices 712, a graphics processor 706, and a display 708, i.e. a conventional CRT (cathode ray tube), LCD (liquid crystal display), LED (light emitting diode), plasma display or the like. User input may be received from the input devices 712, e.g., keyboard, mouse, touchpad, microphone, and the like. In one embodiment, the graphics processor 706 may include a plurality of shader modules, a rasterization module, etc. Each of the foregoing modules may even be situated on a single semiconductor platform to form a graphics processing unit (GPU).

In the present description, a single semiconductor platform may refer to a sole unitary semiconductor-based integrated circuit or chip. It should be noted that the term single semiconductor platform may also refer to multi-chip modules with increased connectivity which simulate on-chip operation, and make substantial improvements over utilizing a conventional central processing unit (CPU) and bus implementation. Of course, the various modules may also be situated separately or in various combinations of semiconductor platforms per the desires of the user.

The system 700 may also include a secondary storage 710. The secondary storage 710 includes, for example, a hard disk drive and/or a removable storage drive, representing a floppy disk drive, a magnetic tape drive, a compact disk drive, digital versatile disk (DVD) drive, recording device, universal serial bus (USB) flash memory. The removable storage drive reads from and/or writes to a removable storage unit in a well-known manner.

Computer programs, or computer control logic algorithms, may be stored in the main memory 704 and/or the secondary storage 710. Such computer programs, when executed, enable the system 700 to perform various functions. The memory 704, the storage 710, and/or any other storage are possible examples of computer-readable media.

In one embodiment, the architecture and/or functionality of the various previous figures may be implemented in the context of the central processor 701, the graphics processor 706, an integrated circuit (not shown) that is capable of at least a portion of the capabilities of both the central processor 701 and the graphics processor 706, a chipset (i.e., a group of integrated circuits designed to work and sold as a unit for performing related functions, etc.), and/or any other integrated circuit for that matter.

Still yet, the architecture and/or functionality of the various previous figures may be implemented in the context of a general computer system, a circuit board system, a game console system dedicated for entertainment purposes, an application-specific system, and/or any other desired system. For example, the system 700 may take the form of a desktop computer, laptop computer, server, workstation, game consoles, embedded system, and/or any other type of logic. Still yet, the system 700 may take the form of various other devices including, but not limited to a personal digital assistant (PDA) device, a mobile phone device, a television, etc.

Further, while not shown, the system 700 may be coupled to a network (e.g., a telecommunications network, local area network (LAN), wireless network, wide area network (WAN) such as the Internet, peer-to-peer network, cable network, or the like) for communication purposes.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method, comprising:

receiving a first image;

combining a cursor at a first position with the first image to produce a first combined image;

displaying the first combined image on a variable refresh rate display device;

determining that a refresh timeout corresponding to a cursor redraw rate that is based on the first position and a second position has occurred, wherein the cursor redraw rate is less than a maximum refresh frequency associated with the variable refresh rate display device;

determining that a second image has not been generated; and combining the cursor at the second position with the first image to produce a second combined image for display.

2. The method of claim 1, wherein a difference between the first position and the second position is greater than a threshold amount that is based on a resolution of the variable refresh rate display device.

3. The method of claim 1, wherein a GPU is configured to combine the cursor at the first position with the first image and combine the cursor at the second position with the first image.

4. The method of claim 1, wherein the variable refresh rate display device is configured to combine the cursor at the first position with the first image and combine the cursor at the second position with the first image.

5. The method of claim 1, wherein the variable refresh rate display device is one of a liquid crystal display (LCD), a light emitting diode (LED) display, an organic light emitting diode (OLED) display, and an active-matrix OLED (AMOLED) display.

6. The method of claim 1, wherein the second combined image comprises only one or more pixels that have changed relative to the first combined image and is defined as a cursor region of one or more pixels that includes the cursor at the first position and the cursor at the second position.

7. The method of claim 6, further comprising redrawing the cursor region to refresh the variable refresh rate display device, wherein the redrawing erases the cursor at the first position and draws the cursor at the second position.

8. The method of claim 1, further comprising:

displaying the second combined image on the variable refresh rate display device;

determining that the refresh timeout associated with the variable refresh rate display device has occurred while displaying the second combined image;

determining that the second image has been generated; and combining the cursor at a third position with the second image to produce a third combined image for display.

9. A non-transitory computer-readable storage medium storing instructions that, when executed by a processor, cause the processor to perform steps comprising:

receiving a first image;

combining a cursor at a first position with the first image to produce a first combined image;

displaying the first combined image on a variable refresh rate display device;

determining that a refresh timeout corresponding to a cursor redraw rate that is based on the first position and a second position has occurred, wherein the cursor redraw rate is less than a maximum refresh frequency associated with the variable refresh rate display device;

determining that a second image has not been generated; and combining the cursor at the second position with the first image to produce a second combined image for display.

10. The non-transitory computer-readable storage medium of claim 9, wherein a difference between the first position and the second position is greater than a threshold amount that is based on a resolution of the variable refresh rate display device.

11. The non-transitory computer-readable storage medium of claim 9, wherein the second combined image comprises only one or more pixels that have changed relative to the first combined image and is defined as a cursor region of one or more pixels that includes the cursor at the first position and the cursor at the second position.

12. A system, comprising:

a processor configured to:

receive a first image;

combine a cursor at a first position with the first image to produce a first combined image;

transmit the first combined image for display;

determine that a refresh timeout corresponding to a cursor redraw rate that is based on the first position and a second position has occurred, wherein the cursor redraw rate is less than a maximum refresh frequency associated with a variable refresh rate display device;

determine that a second image has not been generated; and combine the cursor at the second position with the first image to produce a second combined image for display; and the variable refresh rate display device configured to display the first combined image.

13. The system of claim 12, wherein a difference between the first position and the second position is greater than a threshold amount that is based on a resolution of the variable refresh rate display device.

14. The system of claim 12, wherein the processor is a graphics processing unit (GPU).

15. The system of claim 12, wherein the processor is one of a scaling unit included in the variable refresh rate display device and a timing controller included in the variable refresh rate display device.

16. The system of claim 12, wherein the second combined image comprises only one or more pixels that have changed relative to the first combined image and is defined as a cursor region of one or more pixels that includes the cursor at the first position and the cursor at the second position.

17. The method of claim 1, wherein the refresh timeout also corresponds to an image repetition rate that is within a range of $[R_{min}, R_{max}]$ computed based on an image duration for rendering the first image.

18. The method of claim 17, wherein $R_{min}$ is computed as a ratio between the image duration and a maximum frame duration associated with the variable refresh rate display device and $R_{max}$ is computed as a ratio between the image duration and a minimum frame duration associated with the variable refresh rate display device.

19. The method of claim 17, wherein the image repetition rate comprises at least two integer values.

20. The method of claim 1, wherein the refresh timeout is greater than a minimum refresh frequency associated with the variable refresh rate display device.

* * * * *